US005405732A

United States Patent [19]

Shimizu et al.

[11] Patent Number: 5,405,732

[45] Date of Patent: Apr. 11, 1995

[54] METHOD FOR PROCESSING BLACK-AND-WHITE SILVER HALIDE PHOTOGRAPHIC LIGHT-SENSITIVE MATERIALS

[75] Inventors: Akira Shimizu; Shoji Nishio; Takeshi Sanpei; Hiroyuki Ushiroyama, all of Hino, Japan

[73] Assignee: Konica Corporation, Tokyo, Japan

[21] Appl. No.: 178,643

[22] Filed: Jan. 5, 1994

[30] Foreign Application Priority Data

Jan. 21, 1993 [JP] Japan ..... 5-026133

[51] Int. Cl.[6] ..... G03C 1/06

[52] U.S. Cl. ..... 430/264; 430/265; 430/434; 430/458; 430/465

[58] Field of Search ..... 430/264, 265, 434, 458, 430/465

[56] References Cited

U.S. PATENT DOCUMENTS 3,158,482 11/1964 Lucas ..... 430/465
5,272,046 12/1993 Sasaoka ..... 430/963
5,283,161 2/1994 Toya et al. ..... 430/963

*Primary Examiner*—Hoa Van Le
*Attorney, Agent, or Firm*—Jordan B. Bierman; Bierman and Muserlian

[57] ABSTRACT

A process for processing a black-and-white silver halide photographic light-sensitive material is disclosed, the material comprising a photographic component layer containing a hydrazine compound, and the process comprising the step of exposing the light-sensitive material, and developing the exposed material with developer having a pH of not more than 10.7, the developer being prepared from a solid developing composition and the developer being replenished with developer replenisher in an amount of not more than 250 cc per $m^2$ of the light-sensitive material to be developed.

15 Claims, No Drawings

METHOD FOR PROCESSING BLACK-AND-WHITE SILVER HALIDE PHOTOGRAPHIC LIGHT-SENSITIVE MATERIALS

FIELD OF THE INVENTION

The present invention relates to a method for processing a black-and-white silver halide photographic light-sensitive material, particularly to a method for processing a black-and-white silver halide photographic light-sensitive material excellent in processing stability.

BACKGROUND OF THE INVENTION

There are various supplying method of a processing solution for a photographic light-sensitive material.

In photographic processing carried out with an automatic processor to develop, fix and bleach the light-sensitive material, a specific amount of processing agents is supplied as replenishers to the processor to compensate loss of the processing solution caused by being taken out together with the light-sensitive material to be processed or by being evaporated, oxidized or deteriorated. Such replenishers are generally sold in the form of concentrated solutions to be diluted with water when used.

However, undesirable problems sometimes arise in the method where such concentrated solutions are diluted. To be concrete, when a light-sensitive material is processed with a developer containing a conventional polyhydroxy benzene type developing agent, problems do not arise as long as processing is carried out at normal intervals, but when processing leaves a processing solution unreplenished at long intervals, the solution allows air oxidation to proceed, resulting in deteriorating the developer's activity and thereby lowering the photographic sensitivity. For example, when a light-sensitive material is processed, the operation of the automatic developer is closed at night and a light-sensitive material of the same kind is processed on the following morning, the sensitivity of the latter light-sensitive material fluctuates much more than that of the former light-sensitive material. In such a case, the activity of the developer must be restored by supplying a large amount of developer replenisher and, as a result, the efficiency of operation is lowered to a large extent. Further, in a recent processing system which uses a replenisher in a small amount for minimizing the amount of photographic waste liquor in view of environmental protection, a processing solution in running state is low in activity because of a small replenishing amount, while the tolerance for deterioration in developer activity has become very small owing to shortening of developing time brought about by the recent tendency toward more rapid developing. To cope with such a problem, there have so far been made various attempts such as thinning of a light-sensitive material by decreasing the binder amount used in a light-sensitive material, minimization of deterioration in developing activity by lessening the amount of silver halide contained in a light-sensitive material, and raise of developing temperature. However, these attempts are not effective enough to solve the problem, and the lowering in photographic sensitivity becomes intensified in photographic operation. In addition, disposal of waste processing solutions becomes difficult because of organic solvents contained therein; therefore, decrease in amount of organic solvents, particularly ethylene glycols (DEG, TEG, etc.) generally contained in a processing solution is strongly demanded.

Further, there are developed in recent years high contrast light-sensitive materials for use in printing by incorporating a contrast improver such as a hydrazine compound in light-sensitive emulsions. These light-sensitive materials have an advantage of being processed with a highly preservative developer having a sodium sulfite content larger than that of a lith developer, so that the use of a lith developer of poor preservability can be avoided. However, such light-sensitive materials are highly sensitive to a small fluctuation in developer's activity; therefore, to say nothing of the foregoing problems, these are liable to cause troubles such as sharpness or pepper spots when subjected to continuous processing (to be in running state).

Fixers, though not so susceptible as developers, have similar problems and, when left unused for a long time in an automatic processor, they are deteriorated in fixing capability and hardening capability. In fact, troubles such as fixing failure and hardening failure are often found in the recent rapid processing carried out at low replenishing rates using automatic processors.

SUMMARY OF THE INVENTION

Accordingly, an object of the present invention is to provide a processing method which can maintain stable processing capabilities even in processing of light-sensitive materials containing a contrast improver such as a hydrazine compound, particularly a processing method which uses, in processing with an automatic processor, a processing solution causing neither KIRE nor pepper spots in running state and enabling the content of organic solvents to be reduced markedly.

The object of the invention is achieved by a method for a process for processing a black-and-white silver halide photographic light-sensitive material comprising a support and provided thereon, a photographic component layer comprising a silver halide emulsion layer, the photographic component layer containing a hydrazine compound, comprising the step of exposing the light-sensitive material and developing the exposed material with developer having a pH of not more than 10.7, the developer being prepared by dissolving a solid developing composition in water and the developer being replenished with developer replenisher in an amount of 250 cc per $m^2$ of the light-sensitive material to be developed.

DETAILED DESCRIPTION OF THE INVENTION

The present invention is based upon striking findings obtained through studies made by present inventors. That is, the foregoing problems such as deterioration of a processing solution do not arise when a replenisher is prepared from its components immediately before use; however, when the replenisher is aged and used, the foregoing problems come out.

In general, it is difficult for users to prepare by themselves a processing solution from its components, and therefore such components must be supplied as a kit of processing agent. In such a case, a kit in the form of solution cannot solve the foregoing problems, since it takes at least several days to deliver a kit made afresh to a user. The problems can be solved only when such a kid is supplied in the form of solid. The foregoing problems may arise even in light-sensitive materials which are processed with a conventional powder processing agent, but those problems are not actually developed. This is attributed to the facts that these light-sensitive materials are low in sensitivity and require a long processing time or have a wide allowance in processing conditions and enable a low temperature processing. The invention will hereinafter be described in detail.

The solid processing composition used in the invention includes those having the general form of solid such as, granule, tablet, paste or a mixture thereof. In case of being a paste, the viscosity is preferably 5 p or more.

The solid processing composition of the present invention is defined to be one solidifying a component essential for effecting as a developer. In other words, the solid processing composition of the present invention is a solidified component which can serve as a developer solution by adding only water thereto.

In dissolving the solid processing composition of the invention, either a manual method or a mechanical method may be used as in preparation of the usual solution. A replenishing tank may be provided on the inside or outside of an automatic processor. The processing composition may be supplied in any form as long as it is prevented from scattering. For example, the solid processing composition may be wrapped up in a water-soluble polymer film and thrown into a tank as it is, or it may be packaged with paper surface-treated with polyethylene or the like and added in a tank with care not to scatter or leave it in the packaging. In view of the solubility of the processing agent in water, granules and tablets are preferred as the form of solid. Some photographic processing components are sparingly soluble in water and apt to deposit in a processing solution. In order to avoid such deposition, a solvent may be added separately. In forming granules or tablets, use of a conventional granulation aid, is preferred. In practice, there can be used, singly or in combination of two or more kinds, granulation aids selected from gelatin, pectin, polyacrylic acid, polyacrylic acid salts, polyvinyl alcohol, polyvinyl pyrrolidone, vinyl acetate copolymers, polyethylene oxide, sodium carboxymethyl cellulose, hydroxypropyl cellulose, methyl cellulose, ethyl cellulose, alginates, xanthan gum, gum arabic, gum traganth, carrageenan, methyl vinyl ether-maleic anhydride copolymers, polyoxyethylene alkyl ethers such as polyoxyethylene ethyl ether and polyoxyethylene stearyl ether, polyoxyethylene alkylphenol ethers such as polyoxyethylene octylphenol ether and polyoxyethylene nonylphenol ether, and the water-soluble binders described in Japanese Patent Publication Open to Public Inspection No. 85535/1992 (hereinafter Japanese Pat. O.P.I. Pub.).

The granulation aid used in the invention is preferably a water soluble polymer, such as polyvinyl alcohol, polyvinyl pyrrolidone, polyethylene glycol, and derivatives thereof, carboxymethyl cellulose and polyacrylic acid. The content of the granulation aid is 1 to 10% by weight, and preferably 2 to 5% by weight based on the total solid content of the solid processing composition.

The solid processing composition of the invention contains an organic solvent such as diethylene glycol or triethylene glycol in an amount of not more than 100% by weight based on the total solid content. The organic solvent content is preferably 2 to 100% by weight, and more preferably 5 to 50% by weight, based on the total solid content at 25° C.

In order to improve the preservability of a processing agent in the form of a kit, the processing agent may be packaged in two or more parts of the kit.

Developing agents of the black-and-white developer used in the invention are preferably a combination of dihydroxybenzenes and 1-phenyl-3-pyrazolidones because of its advantage of providing high performance stably. Of course, p-aminophenol type developing agents may be used besides the above developing agents.

The dihydroxybenzene developing agents used in the invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Of them, hydroquinone is particularly preferred.

The developing agents 1-Phenyl-3-pyrazolidone or its derivatives used in the invention include 1-phenyl-4,4-dimethyl- 3-pyrazolidone, 1-phenyl-4-methyl-4-hydroxymethyl-3pyrazolidone, and 1-phenyl-4,4-dihydroxymethyl-3-pyrazolidone.

p-Aminophenol developing agents used in the invention include N-methyl-p-aminophenol, p-aminophenol, N-(β-hydroxyethyl)-p-aminophenol, N-(4-hydroxyphenyl)glycine, 2-methyl-p-aminophenyl, and p-benzylaminophenyl. Among them, preferred is N-methyl-p-aminophenol.

These developing agents are usually employed in an amount of 0.01 mol/l to 1.2 mol/l.

Sulfite preservatives used in the invention include sodium sulfite, potassium sulfite, lithium sulfite, ammonium sulfite, sodium bisulfite, potassium metabisulfite, and sodium formaldehyde bisulfite. Preferably, these sulfites are used in an amount of 0.2 mol/l or more and preferably 0.4 mol/l or more, within the limit of 2.5 mol/l.

In the embodiment of the invention, the pH of the developer used in the invention is 10.7 or less, preferably 9.5 to 10.7, and more preferably 10.0 to 10.5. As alkali agents for adjusting the pH, there can be used pH adjustors such as sodium hydroxide, potassium hydroxide, sodium carbonate, potassium carbonate, tribasic sodium phosphate, and tribasic potassium phosphates.

There may also be used buffering agents such as ones described in Japanese Pat. O.P.I. Pub. No. 28708/1986 borates), ones described in Japanese Pat. O.P.I. Pub. No. 93439/1985 (e.g., saccharose, acetoxime, 5-sulfosalicylic acid), phosphates, and carbonates.

Besides the above components, the developer used in the invention may contain developing inhibitors such as sodium bromide, potassium bromide; organic solvents such as ethylene glycol, diethylene glycol, triethylene glycol, dimethylformamide, methyl cellosolve, hexylene glycol, ethanol, methanol; and antifoggants such as mercapto compounds including 1-phenyl-5-mercaptotetrazole, sodium 2-mercaptobenzimidazole-5-sulfonate, indazole compounds including 5-nitroindazole and benzotriazole compounds including 5-methylbenzotriazole. If necessary, there may further be contained tone controlling agents, surfactants, defoamers, water softeners, and the amino compounds described in Japanese Pat. O.P.I. Pub. No. 106244/1981.

Further, the developer used in the invention may employ silver stain inhibitors, for example, those described in Japanese Pat. O.P.I. Pub. No. 24347/1981. The developer of the invention may contain amino compounds such as the alkanolamines described in Japanese Pat. O.P.I. Pub. No. 106244/1981.

In addition, there may also be used the compounds described on pages 226–229 of "Photographic Processing Chemistry" by L. F. A. MESON, Focal Press Co. (1966), in U.S. Pat. Nos. 2,193,015 and 2,592,364, and Japanese Pat. O.P.I. Pub. No. 64933/1973.

When pH of a developer prepared from a solid developing composition exceeds 10.7, the storage stability of the solid developing composition is more noticeably deteriorated than when the pH is not more than 10.7. In addition, when pH is less than 9.5, the activity of the developer is extremely lowered. Therefore, when a light-sensitive material containing hydrazine is developed at a pH of less than 9.5, sensitivity and the maximum density is reduced so that it cannot be put into practical use.

There is no limitation to the amount of replenishing a developer. When a light-sensitive material is processed in an automatic processing machine, hydroquinone, which is a developing agent, is consumed so that the activity of the developer is reduced. By replenishing the developer, activity is kept constant. When a replenisher for the developer once prepared from a solid processing composition is stored in a reserving tank, activity of the developer is enhanced due to air-oxidation and evaporation of water. Accordingly, when the replenisher for the developer is replenished in a large amount, the activity of the developer is too much raised so that deterioration of the light-sensitive material such as fogging and black spots is caused. Therefore, according to the study of the present inventors, it was proven that the preferable amount of replenishing is 250 cc/m$^2$ or less. The range of the replenishing amount of developer is preferably 60 to 250 cc/m$^2$ and more preferably 100 to 200 cc/m$^2$.

There is no limitation to a developing time. The developing time is preferably 18 seconds or less. In addition, when the developing time of photographic processing is less than 7 seconds, image forming has not been completed sufficiently. Accordingly, the more preferable is 7 to 18 seconds.

A fixer is usually an aqueous solution containing a thiosulfate and having a pH of 3.8 or more, preferably 4.2 to 5.5. As such a fixer, one prepared from a solid processing agent is preferred. The term "solid" used here is the same as that defined with respect to the developer.

A fixing agent includes, for example, sodium thiosulfate and ammonium thiosulfate. Preferred are those containing thiosulfate ions and ammonium ions as essential components; particularly preferred is ammonium thiosulfate in view of its fixing speed.

The content of the fixing agent can be varied according to specific requirements, but it is usually within the range of about 0.1 mol/l to about 6 mol/l.

The fixer may contain a water-soluble aluminum salt which functions as a hardener. Examples thereof include aluminum chloride, aluminum sulfate and potassium alum.

Further, the fixer may use, singly or in combination, tartaric acid, citric acid and their derivatives. A fixer which contains these compounds in an amount of 0.005 mol/l or more is effective in embodying the invention; one containing them in an amount of from 0.01 mol/l to 0.03 mol/l is particularly effective.

Suitable examples include tartaric acid, potassium tartrate, sodium tartrate, potassium sodium tartrate, citric acid, sodium citrate, potassium citrate, lithium citrate and ammonium citrate.

When necessary, the fixer may contain preservatives such as sulfites, bisulfite; pH buffering agents such as acetic acid, nitric acid; pH adjustors such as sulfuric acid; and chelating agents having water-softening capabilities.

The hydrazine compound contained in a light-sensitive material to be processed according to the invention is preferably one represented by the following formula [H]:

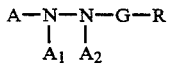

Formula [H]

In the formula, A represents an aryl group or a heterocyclic group containing at least one sulfur or oxygen atom; G represents a

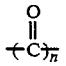

group, a sulfonyl group, a sulfoxy group,

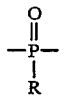

group or an iminomethylene group; n represents an integer of 1 or 2; $A_1$ and $A_2$ represent hydrogen atoms concurrently, or one of them represents a hydrogen atom and the other represents a substituted or unsubstituted alkylsulfonyl group or a substituted or unsubstituted acyl group; R represents a hydrogen atom, an alkyl, aryl, alkoxy, aryloxy, amino, carbamoyl or oxycarbamoyl group, or a —O—$R_2$ group, wherein $R_2$ represents an alkyl or saturated heterocyclic group.

Among these hydrazine compounds, those represented by the following formula [H-c] or [H-d] are preferred in the embodiment of the invention.

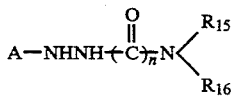

Formula [H-c]

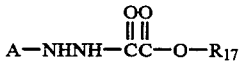

Formula [H-d]

In the formula, A represents an aryl group or a heterocyclic group containing at least one sulfur or oxygen atom, and n represents an integer of 1 or 2. When n is 1, $R_{15}$ and $R_{16}$ each represent a hydrogen atom or an alkyl, alkenyl, alkynyl, aryl, heterocyclic, hydroxyl, alkoxy, alkenyloxy, alkynyloxy, aryloxy or heterocycloxy group, provided that $R_{15}$ and $R_{16}$ may form a ring together with a nitrogen atom. When n is 2, $R_{15}$ and $R_{16}$ each represent a hydrogen atom or an alkyl, alkenyl, alkynyl, aryl, saturated or unsaturated heterocyclic, hydroxyl, alkoxy, alkenyloxy, alkynyloxy, aryloxy or heterocycloxy group, provided that at least one of $R_{15}$ and $R_{16}$ is an alkenyl, alkynyl, saturated heterocyclic, hydroxyl, alkoxy, alkenyloxy, alkynyloxy, aryloxy or heterocycloxy group. $R_{17}$ represents an alkynyl or saturated heterocyclic group.

The compounds represented by formula [H-c] or [H-d] include those in which at least one of H in the group of —NHNH— is replaced by a substituent.

To be more precise, A represents an aryl group such as phenyl, naphthyl, or a heterocyclic group containing at least one sulfur or oxygen atom such as thiophene, furan, benzothiophene, pyran.

$R_{15}$ and $R_{16}$ each represents a hydrogen atom; an alkyl group such as methyl, ethyl, methoxyethyl, cyanoethyl, hydroxyethyl, benzyl, trifluoroethyl; an alkenyl group such as allyl, butenyl, pentenyl, pentadienyl; an alkynyl group such as propargyl, butynyl, pentynyl; an aryl group such as phenyl, naphthyl, cyanophenyl, methoxyphenyl; a heterocyclic group including an unsaturated heterocyclic group such as pyridine, thiophene, furan and a saturated heterocyclic group such as tetrahydrofuran, sulfolane; a hydroxyl group; an alkoxy group such as methoxy, ethoxy, benzyloxy, cyanomethoxy; an alkenyloxy group such as allyloxy, butenyloxy; an alkynyloxy group such as propargyloxy, butynyloxy; an aryloxy group such as phenoxy, naphthyloxy; or a heterocycloxy group such as pyridyloxy, pyrimidyloxy. When n is 1, $R_{15}$ and $R_{16}$ may form a ring, such as a piperidine, piperazine or morpholine ring, jointly with a nitrogen atom.

When n is 2, however, at least one of $R_{15}$ and $R_{16}$ is an alkenyl, alkynyl, saturated heterocyclic, hydroxyl, alkoxy, alkenyloxy, alkynyloxy, aryloxy or heterocycloxy group.

Examples of the alkynyl group or saturated heterocyclic group represented by $R_{17}$ include those described above.

A variety of substituents may be introduced into the aryl group or heterocyclic group having at least one sulfur or oxygen atom. Examples of such substituents include halogen atoms and the groups of alkyl, aryl, alkoxy, aryloxy, acyloxy, alkyloxy, arylthio, sulfonyl, alkoxycarbonyl, aryloxycarbonyl, carbamoyl, sulfamoyl, acyl, amino, alkylamino, arylamino, acylamino, sulfonamido, arylaminothiocarbonylamino, hydroxyl, carboxyl, sulfo nitro, cyano, etc. Of these substituents, preferred is a sulfonamido group.

In each of the above formulas, it is preferred that A contain at least one non-diffusible group or group which accelerates adsorption of silver halides. A preferred example of the non-diffusible group is a ballast group which is commonly used in immovable photographic additives such as couplers. Such a ballast group, a group having 8 or more carbon atoms and relatively inactive to photographic properties, can be selected, for example, from the groups of alkyl, alkoxy, phenyl, alkylphenyl, phenoxy and alkylphenoxy.

Examples of the group which accelerates adsorption of silver halides include the groups described in U.S. Pat. No. 4,385,108 such as thiourea, thiourethane, heterocyclic thioamido, heterocyclic mercapto and triazole groups.

H in the group of —NHNH— contained in formula [H-c] or [H-d], or a hydrogen atom in the hydrazine structure, may be replaced by a substituent selected from a sulfonyl group such as methanesulfonyl or toluenesulfonyl; an acyl groups such as acetyl, trifluoroacetyl, or ethoxycarbonyl; and an oxalyl group such as ethoxalyl or pyruvoyl; that is, the compound represented by formula [H-c] or [H-d] includes those substituted as described above.

In the embodiment of the invention, preferred are compounds of formula [H-c] wherein n being 2 and compounds of formula [H-d].

In the compounds of n being 2 in formula [H-c], particularly preferred are those in which $R_{15}$ and $R_{16}$ independently represent a hydrogen atom or an alkyl, alkenyl, alkynyl, aryl, saturated or unsaturated heterocyclic, hydroxyl or alkoxy group, and at least one of $R_{15}$ and $R_{16}$ represents an alkenyl, alkynyl, saturated or unsaturated heterocyclic, hydroxyl or alkoxy group.

The following are examples of the compound represented by formula [H-c] of [H-d]. However, as a matter of course, the compound of formula [H-c] or [H-d] usable in the invention is not limited to these examples.

Examples of the compound

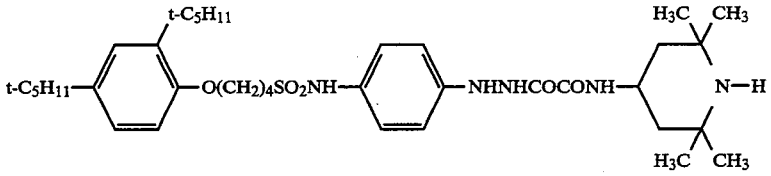

c-1

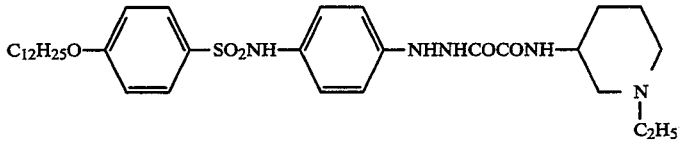

c-2

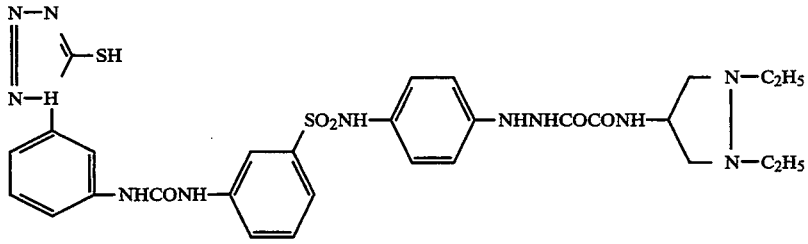

c-3

-continued
d-1
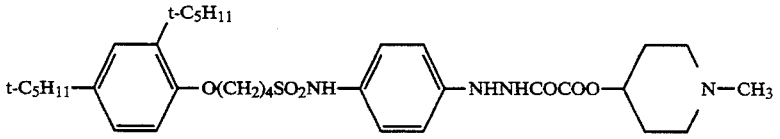
c-4
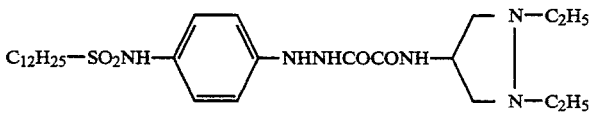
c-5
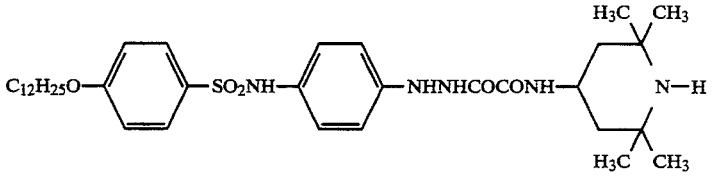
d-2
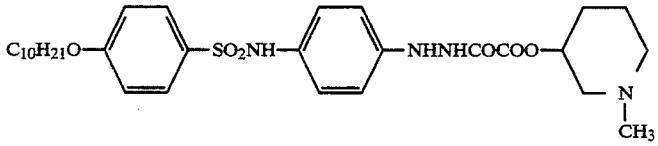
c-6
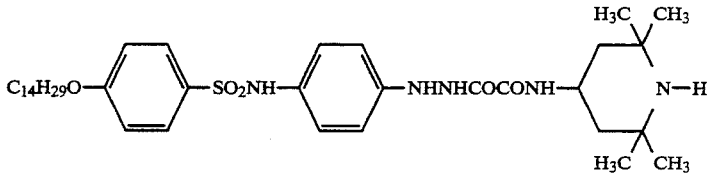
d-3
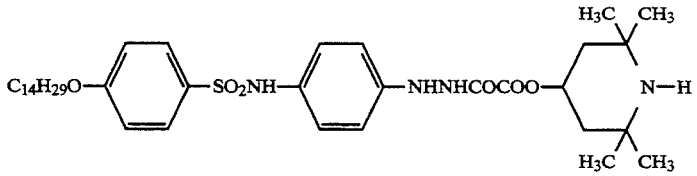
c-7
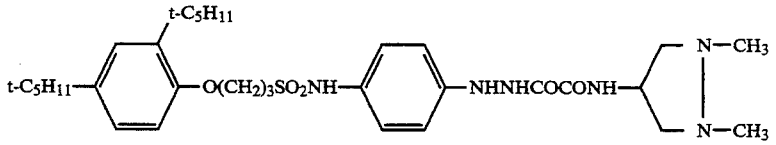
d-4
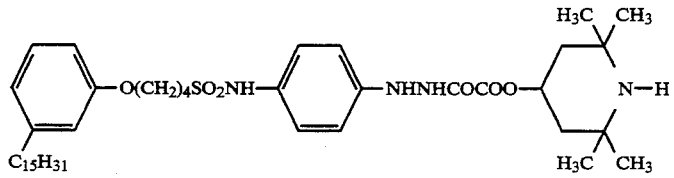
c-8
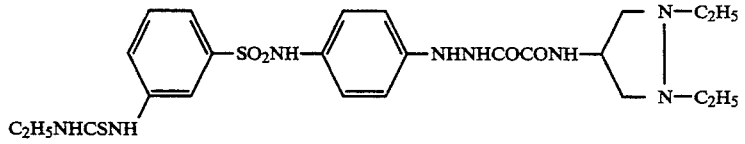

-continued

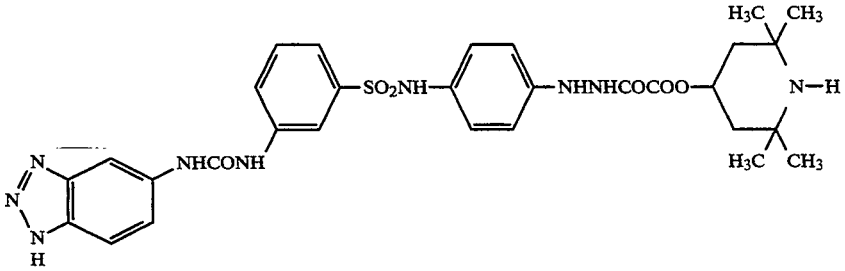

d-5

Examples of other usable compounds include compound Nos. 1 to 61 and 65 to 75 illustrated on pages 542–545 (4–8) of Japanese Pat. O.P.I. Pub. No. 841/1990.

The hydrazine compound used in the invention can be synthesized according to the method described on pages 546–550 (8–12) of Japanese Pat. O.P.I. Pub. No. 841/1990.

The hydrazine compound of the invention is added to a silver halide emulsion layer and/or its adjacent layer in an amount of preferably $1\times10^{-6}$ to $1\times10^{-1}$ mol per mol of silver, and more preferably $1\times10^{-5}$ to $1\times10^{-2}$ mol per mol of silver.

When the hydrazine compound of formula [H-c] or [H-d] is used, it is preferred that at least one of the nucleation accelerators illustrated from the first line in the lower left column on page 7 to the 11th line of the lower left column on page 26 of Japanese Pat. O.P.I. Pub. No. 98239/1992 be contained in a silver halide emulsion layer and/or a nonlight-sensitive layer provided on a support oppositely with the silver halide emulsion layer.

Typical examples of the nucleation accelerators are those illustrated below:

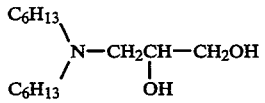

N-1

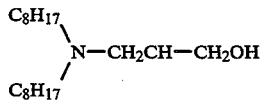

N-2

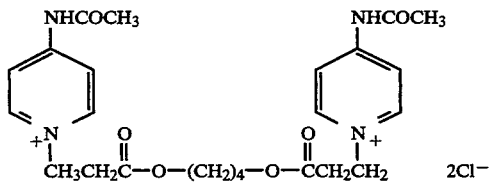

N-3

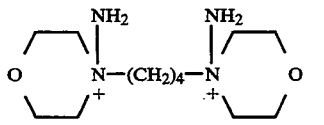

N-4

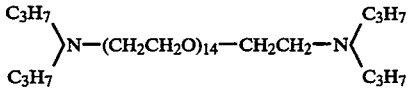

N-5

-continued

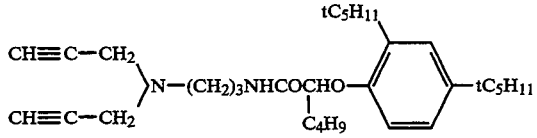

N-6

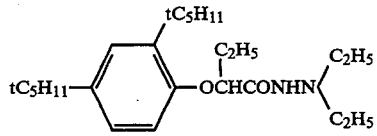

N-7

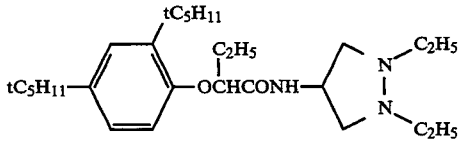

N-8

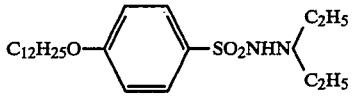

N-9

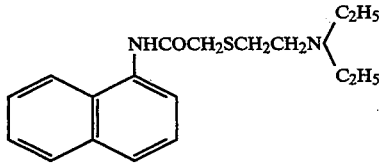

N-10

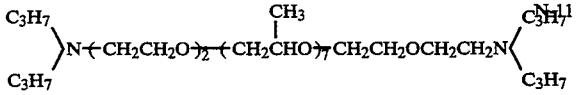

N-11

A variety of usable nucleation accelerators are illustrated in Japanese Pat. O.P.I. Pub. No. 98239/1992. Such nucleation accelerators include, though some of them are already illustrated as the above typical examples, compounds I-1 to I-26 illustrated on page 8 of the above patent specification, compounds II-1 to II-29 on pages 9–10, compounds III-1 to III-25 on pages 10–11, compounds IV-1 to IV-41 on pages 84–90, compounds V-I-1 to V-I-27 on pages 11–13, compounds V-II-1 to V-II-30 on pages 13–14, compound V-III-35 on page 16, compounds VI-I-1 to VI-I-44 on pages 18–20, compounds VI-II-1 to VI-II-68 on pages 21–24, and compounds VI-III-1 to VI-III-35 on pages 24–26.

In a preferred embodiment of the invention, the monodispersion degree of silver halide grains contained in a light-sensitive material is adjusted to 5 to 60, especially 8 to 30. In the present specification, the size of silver halide grains is expressed by the edge length of a cubic grain for convenience, and the monodispersion degree is given by centupling the value obtained by dividing a standard deviation of grain size distribution by an average grain size.

As silver halide grains contained in a light-sensitive material to be processed, grains having multi-layer structure comprising at least two layers are preferred. There can be used, for example, silver chlorobromide grains having a silver chloride core and a silver bromide shell, or silver chlorobromide grains having a silver bromide core and a silver chloride shell. Silver iodide may also be contained in any of these layers in amounts not more than 5 mol %.

Further, there can be used a mixture containing at least two kinds of grains. Examples of such a mixture include those in which principal grains are cubic, octahedral or tabular silver chloroiodobromide grains containing 10 mol % or less silver chloride and 5 mol % or less silver iodide, and secondary grains are cubic, octahedral or tabular silver chloroiodobromide grains containing 5 mol % or less silver iodide and 50 mol % or more silver chloride. When such a mixture is used, while chemical sensitization of principal and secondary grains is optional, secondary grains may be made lower than principal grains in sensitivity by refraining chemical sensitization (e.g., sulfur sensitization or gold sensitization), or may be lowered in sensitivity by adjusting the grain size or the amount of noble metals, such as rhodium, used to dope grains. Further, the inside of secondary grains may be fogged by use of a gold compound or by changing the compositions of cores and shells according to the core/shell method. The size of principal grains and secondary grains can take any value within the range of 0.025 μm to 0.0 μm, though photographic properties become better with decrease in size of these grains.

In preparing a silver halide emulsion used in the invention, a rhodium salt may be added thereto for the purpose of controlling sensitivity or gradation. Preferably, the addition of a rhodium salt is made in the process of grain formation, but it may be made during chemical ripening or at the time of preparing an emulsion coating solution.

The rhodium salt added to a silver halide emulsion used in the invention may be either a simple salt or a double salt. Typically, rhodium chloride, rhodium trichloride and rhodium ammonium chloride are used.

The addition amount of these rhodium salts can be varied according to desired sensitivities or gradations, but the addition amount within a ranging of $10^{-9}$ mol to $10^{-4}$ mol per mol of silver is particularly effective.

Further, other inorganic compounds, such as iridium salts, platinum salts, thallium salts, cobalt salts and gold salts, may be used jointly with the rhodium salts. Iridium salts can be favorably used in amounts of $10^{-9}$ mol to $10^{-4}$ mol per mol of silver to improve high intensity properties.

Silver halides used in the invention can be sensitized by use of various chemical sensitizers. As such sensitizers, there can be used, singly or in combination of two or more kinds, ones selected from active gelatins; sulfur sensitizers such as sodium thiosulfate, allyl thiocarbamide, thiourea, allyl isothiocyanate; selenium sensitizers such as N,N-dimethyl selenourea, selenourea; reduction sensitizers such as triethylenetetramine, stannous chloride; and a variety of noble metal sensitizers represented by potassium chloroaurite, potassium aurithiocyanate, potassium chloroaurate, 2-aurosulfobenzothiazole methyl chloride, ammonium chloropalladate, potassium chloroplatinate, sodium chloropalladite. When gold sensitizers are used, ammonium thiocyanate may be employed as an auxiliary sensitizer.

The silver halide emulsions used in the invention may employ desensitizing dyes and/or ultraviolet absorbents described in, for example, U.S. Pat. Nos. 3,567,456, 3,615,639, 3,579,345, 3,615,608, 3,598,596, 3,598,955, 3,592,653, 3,582,343, and Japanese Pat. Exam. Pub. Nos. 26751/1965, 27332/1965, 131167/1968, 8833/1970, 8746/1972.

Further, the silver halide emulsions used in the invention can be stabilized by use of the compounds described in, for example, U.S. Pat. Nos. 2,444,607, 2,716,062, 3,512,982, German Auslegeschrift Nos. 1,189,380, 2,058,626, 2,118,411, Japanese Pat. Exam. Pub. No. 4133/1968, U.S. Pat. No. 3,342,596, Japanese Pat. Exam. Pub. No. 4417/1972, German Auslegeschrift No. 2,149,789, Japanese Pat. Exam. Pub. Nos. 2825/1964, 13566/1974; preferred examples thereof include 5,6-trimethylene-7-hydroxy-s-triazolo(1,5-a)pyrimidine, 5,6-tetramethylene-7-hydroxy-s-triazolo(1,5-a)pyrimidine, 5-methyl- 7-hydroxy-s-triazolo(1,5-a)pyrimidine, 7-hydroxy-s-triazolo(1,5-a)pyrimidine, 5-methyl-6-bromo-7-hydroxy-s-triazolo(1,5-a)pyrimidine, gallates such as isoamyl gallate, dodecyl gallate, propyl gallate, sodium gallate, mercaptans such as 1-phenyl-5-mercaptotetrazole, 2-mercaptobenzothiazole, benzotriazoles such as 5-bromobenzotriazole, 5-methylbenzotriazole, and benzimidazoles such as 6-nitrobenzimidazole.

In order to enhance the developability of the light-sensitive material, developing agents such as phenidone and hydroquinone and inhibitors such as benzotriazole may be contained in the emulsion. Or, for the purpose of raising the processing capability of the processing solution, developing agents and inhibitors may be contained in a backing layer.

In embodying the invention, gelatin is used most advantageously as a hydrophilic colloid. Suitable hydrophilic colloids other than gelatin include, for example, colloidal albumin, agar, gum arabic, alginic acid, hydrolyzed cellulose acetate, polyacrylamide, iminated polyamide, polyvinyl alcohol, hydrolyzed pollvinyl acetate, gelatin derivatives such as phenyl carbamyl gelatin, acylated gelatin and phthalated gelatin described in U.S. Pat. Nos. 2,614,928, 2,525,753 as well as gelatins grafted with polymerizable ethylenic monomers, such as acrylic acid, styrene, acrylates, methacrylic acid, methacrylates, described in U.S. Pat. Nos. 2,548,520 and 2,831,767. These hydrophilic colloids can also be employed in a layer containing no silver halide such as an antihalation layer, a protective layer or an intermediate layer.

The total amount of gelatin on the emulsion layers side is preferably 3.0 g/m$^2$ or less is preferable on a ground that the reactivity of a developing agent and silver halide in the developing solution is enhanced. In addition, when it is less than 1.5 g/m$^2$, photographic properties and the like is deteriorated in terms of uneven development due to the deterioration of coating property in manufacturing. Therefore, the preferable range is 1.5 to 3.0 g/m$^2$ in the present invention.

Typical examples of the support used in the invention include baryta paper, polyethylene-coated paper, polypropylene synthetic paper, glass plates, cellulose acetate film, cellulose nitrate film, polyester film such as polyethylene terephthalate film, polyamide film, polypropylene film, polycarbonate film and polyseyrene film. These supports are properly selected according to applications of respective silver halide photographic light-sensitive materials.

EXAMPLES

The invention is further illustrated by the following examples, but the scope of the invention is by no means limited to them.

Example 1

Preparation of Silver Halide Photographic Emulsion A

A silver iodobromide emulsion (silver iodide content: 0.7 mol % per mol of silver) was prepared by use of a double-jet mixing method. In the preparation, $K_2IrCl_6$ was added in an amount of $8\times10^{-7}$ mol per mol of silver while mixing was carried out. Obtained was an emulsion comprising cubic monodispersed grains having an average grain size of 0.20 μm and a coefficient of variation of grain size of 9%. After adding sensitizing dye SD-1 in an amount of 8 mg/m², the emulsion was washed and desalted by a usual method. The pAg of the desalted emulsion was 8.0 at 40° C. Subsequently, an aqueous solution of potassium iodide was added to the emulsion in an amount of 0.1 mol % per mol of silver to convert the surface composition of the grains, and then 6.0 mg/m² of a mixture of the following compounds [A], [B] and [C] was added, followed by sulfur sensitization. Emulsion A was thus obtained.

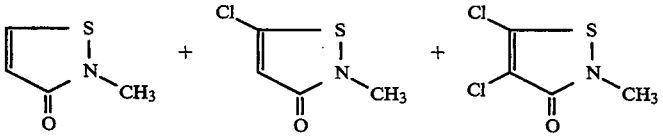

(A) + (B) + (C)

(A):(B):(C) = 5:3:2 (mol ratio)

-continued 6.0 mg/m²

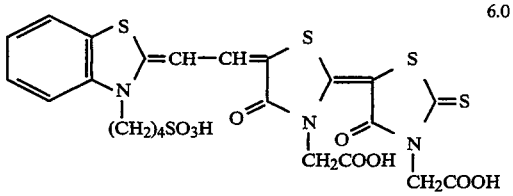

Sensitizing dye: SD-2

1.0 mg/m²

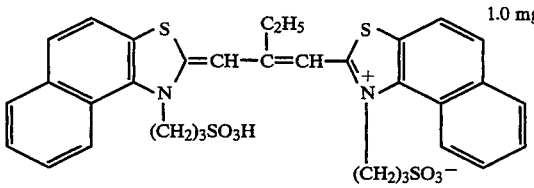

| | |
|---|---|
| Stabilizer: 4-methyl-6-hydroxy-1,3,3a,7-tetrazaindene | 30 mg/m² |
| Antifoggant: adenine | 10 mg/m² |
| : 1-phenyl-5-mercaptotetrazole | 5 mg/m² |
| Surfactant: saponin | 0.1 g/m² |
| Surfactant: S-1 | |

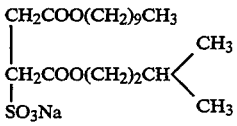

8 mg/m²

Preparation of Silver Halide Photographic Light-sensitive Material

On one side of a 100-μm thick polyethylene terephthalate film provided with a 0.1 mm-thick subbing layer (see Example 1 of Japanese Pat. O.P.I. Pub. No. 19941/1984) on both sides was formed a silver halide emulsion layer of the following formulation (1), so as to give a silver content of 3.2 g/m². Then, an emulsion-protecting layer of the following formulation (2) was formed thereon and, on the other side, a backing layer of the following formulation (3) was formed so as to give a gelatin content of 2.4 g/m², and further a backing-protecting layer of the following formulation (4) was formed thereon so as to give a gelatin content of 1 g/m². Formulation (1) (Silver Halide Emulsion Layer Composition)

Formulation (1) (Silver Halide Emulsion Layer Composition)

| | |
|---|---|
| Gelatin | amounts shown in Tables 1 and 2 |
| Silver halide emulsion (in silver weight) | 3.2 g/m² |
| Sensitizing dye: SD-1 | |
| Hydrazine derivative | shown in Tables 1 and 2 |
| Nucleation accelerator: N-11 | 20 mg/m² |
| Latex polymer: Lx-1 | |

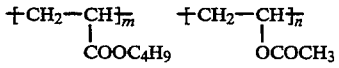

m:n = 50:50 1 g/m²

| | |
|---|---|
| Polyethylene glycol (MW: 4000) | 0.1 g/m² |
| Hardener: H-1 | |

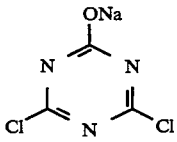

60 mg/m²

Formulation (2) (Emulsion-protecting Layer Composition)

| | |
|---|---|
| Gelatin | shown in Tables 1 and 2 |
| Surfactant: S-2 | |

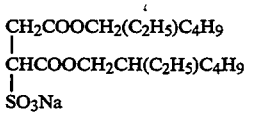

10 g/m²

Surfactant: S-3

-continued

| | |
|---|---|
| 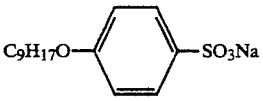 | 5 mg/m² |
| Matting agent: monodispersed silica with an average particle size of 3.5 μm | 5 mg/m² |
| Hardener: 1,3-vinylsulfonyl-2-propanol | 40 mg/m² |

Formulation (3) (Backing Layer Composition)

| | |
|---|---|
| (a) 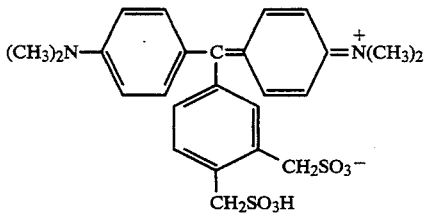 | 70 mg/m² |
| (b) 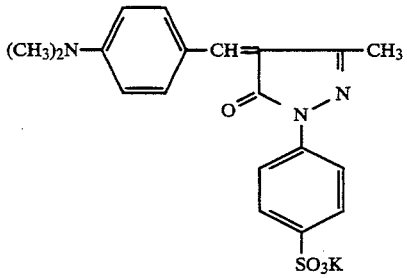 | 50 mg/m² |
| (c) 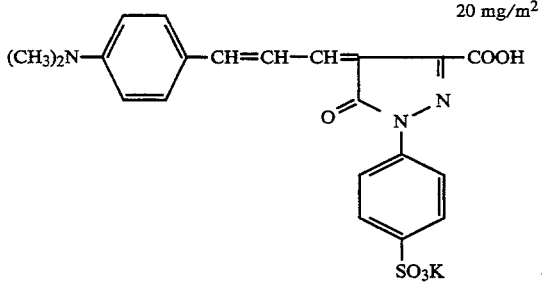 | 20 mg/m² |
| Gelatin | 2.4 g/m² |
| Surfactant: saponin | 0.1 g/m² |
| Surfactant: S-1 | 6 mg/m² |
| Colloidal silica | 100 mg/m² |

Formulation (4) (Backing-protecting Layer Composition)

| | |
|---|---|
| Gelatin | 1 mg/m² |
| Matting agent: monodispersed polymethylmethacrylate with average particle size of 3.5 μm | 40 mg/m² |
| Surfactant: S-2 | 10 mg/m² |
| Hardener: glyoxal | 25 mg/m² |
| Hardener: H-1 | 35 mg/m² |

The sample obtained was exposed in $10^{-6}$ second with a HeNe laser so that exposed portions are 50% of an area of the sample and then processed, under the conditions described later, in a Konica Automatic Rapid Processor GR-26SR charged with a developer and fixer, each having the following compositions, at a developer replenishing rate shown in Table 1 or 2 and at a fixer replenishing rate of 200 ml/m². The developer and fixer for replenishing are the same as the developer and fixer used.

After conducting a three-day operation to process 200 sheets of the above exposed, 610×500 mm size sample per day under the above conditions, the sample was exposed in $10^{-6}$ second through an optical wedge using a He-Ne laser and processed in the same manner as above.

The processed sample was then subjected to densitometry on a Konica Densitometer PDA-65. The results are shown in Tables 1 and 2, in which the sensitivity is given as a value relative to the sensitivity of sample No. 1 at density 2.5, which is set to be 100, and the gamma value is expressed in tangent of a gradient of a line formed by combining points of densities 0.1 and 2.5 in a characteristic curve. When the gamma value is smaller than 8.0, the contrast is not sufficient for practical use.

Evaluation of Sharpness

The sample was exposed in $10^{-6}$ second through a contact screen using a He-Ne laser, and processed in the same manner as above.

The border between exposed portion and unexposed portion of halftone dots was visually observed with a 100-power loupe. Five ranks from 1 to 5 were used in marking, where rank 3 indicates to be acceptable for use, rank 5 to be the best, and rank 1 to be the lowest.

Evaluation of Pepper Spots

The numbers of pepper spots per 0.01 cm² of unexposed portions in the developed sample were counted with a 100-power loupe.

Preparation of Developer

Preparation of Comparative Concentrated Developer (LD-1)

| | |
|---|---|
| Deionized water | 300 ml |
| Hydroquinone | 24 g |
| Methyl-hydroxymethyl-phenidone | 0.88 g |
| Sodium sulfite | 56 g |
| 5-Methyl-benzotriazole | 0.3 g |
| Diethylenetriaminepentaacetic acid | 1.45 g |
| 1-Phenyl-5-mercaptotetrazole | 0.02 g |
| Boric acid | 2.3 g |
| KOH | 8.8 g |
| $K_2CO_3$ | 26.4 g |
| Diethylene glycol (DEG) | |

The concentrated developer so prepared was poured into a PET bottle, followed by replacing with $N_2$ and stopping of the bottle. After storing the bottle in an environment of 50° C. and 48% RH for 7 days, the concentrated solution was diluted to 1 liter with water. The pH was adjusted to values shown in Tables 1 and 2 with 5N aqueous solution of sodium hydroxide.

Preparation of Solid Developer Composition (SD-1)

| | |
|---|---|
| Developer Part A | |
| Sodium sulfite | 56 g |
| $K_2CO_3$ | 26.4 g |
| KOH | 8.8 g |
| Developer Part B | |
| Hydroquinone | 24 g |
| Methyl-hydroxymethyl-phenidone | 0.88 g |
| 5-Methyl-benzotriazole | 0.3 g |
| Diethylenetriaminepentaacetic acid | 1.45 g |
| 1-Phenyl-5-mercaptotetrazole | 0.02 g |
| Boric acid | 2.3 g |
| KBr | 5 g |
| DEG | amounts shown in Tables 1 and 2 |

After mixing the composition of part A uniformly, water and 3 wt % of PEG 1000 were added as binders 10 wt% of based on the total weight of the composition and then, using a commercial stirring granulator, the composition was granulated by stirring and dried by blowing hot air heated at 70° C. into the granulator. The resultant granules were classified through a sieve to obtain granules with sizes ranging from 1.0 mm to 2.0 mm. Developer part B was also granulated in the same manner as in developer part A.

Part A and Part B were mixed and placed in a PET bottle, followed by replacing with $N_2$ and stopping of the bottle. After aging the mixture in the same environment as the comparative developer, the granulated developer was dissolved in water and made up to 1 liter.

Preparation of Fixer

Preparation of Solid Fixer Composition (SF-1)

| | |
|---|---|
| Fixer Part A | |
| Ammonium thiosulfate | 135 g |
| Sodium sulfite | 10 g |
| Sodium citrate | 2 g |
| Sodium acetate | 20 g |
| Fixer Part B | |
| Boric acid | 9.8 g |

-continued

| | |
|---|---|
| Aluminum sulfate.$18H_2O$ | 15 g |

A solid fixer composition (SF-1) was prepared in the same manner as in solid developer composition SD-1. After storing the granulated fixer in the same bottle and under the same conditions as solid developer SD-1, the fixer was dissolved in water and made up to 1 liter, the pH of which was 4.75.

| | Processing Conditions | |
|---|---|---|
| Process | Temperature | Time* |
| Developing | 34° C. | see Tables 1 and 2 |
| Fixing | 32° C. | 10 sec |
| Washing | 25° C. | 10 sec |
| Drying | 45° C. | 13 sec |

Notes: The time includes crossover time.

It can be understood from the results shown in Tables i and 2 that the samples according to the invention are free from sensitivity deterioration, improved in sharpness and less in the occurrence of pepper spots. When the comparative concentrated developer (LD-1) was used, such effects could not be produced.

TABLE 1

| | Light-sensitive Material | | | | | | | |
|---|---|---|---|---|---|---|---|---|
| | Hydrazine Compound | | Emulsion Layer Side Gelatin Content g/m² | | | Developer | | |
| Experiment No. | Compound | Amount Added mg/m² | Emulsion Layer | Protective Layer | Total | Standard Formulation | Amount of DEG g/l | Fresh Solution pH |
| 1-1 | C-7 | 25 | 2.5 | 1.0 | 3.5 | LD-1 | 40 | 10.80 |
| 1-2 | C-7 | 25 | 2.0 | 1.0 | 3.0 | LD-1 | 40 | 10.80 |
| 1-3 | C-7 | 25 | 1.5 | 0.8 | 2.3 | LD-1 | 40 | 10.80 |
| 1-4 | C-7 | 25 | 2.5 | 1.0 | 3.5 | LD-1 | 5 | 10.80 |
| 1-5 | C-7 | 25 | 2.5 | 1.0 | 3.5 | LD-1 | 0 | 10.80 |
| 1-6 | C-7 | 25 | 2.5 | 1.0 | 3.5 | LD-1 | 5 | 10.70 |
| 1-7 | C-7 | 25 | 2.5 | 1.0 | 3.5 | LD-1 | 5 | 10.40 |
| 1-8 | C-7 | 25 | 2.5 | 1.0 | 3.5 | LD-1 | 5 | 10.00 |
| 1-9 | C-7 | 25 | 2.5 | 1.0 | 3.5 | LD-1 | 5 | 10.80 |
| 1-10 | C-7 | 25 | 2.5 | 1.0 | 3.5 | LD-1 | 5 | 10.80 |
| 1-11 | C-7 | 25 | 2.5 | 1.0 | 3.5 | LD-1 | 5 | 10.80 |
| 1-12 | C-7 | 25 | 2.5 | 1.0 | 3.5 | LD-1 | 5 | 10.80 |
| 1-13 | C-7 | 25 | 2.5 | 1.0 | 3.5 | LD-1 | 5 | 10.80 |
| 1-14 | C-7 | 25 | 2.5 | 1.0 | 3.5 | LD-1 | 5 | 10.80 |
| 1-15 | C-7 | 25 | 2.5 | 1.0 | 3.5 | SD-1 | 40 | 10.80 |
| 1-16 | C-7 | 25 | 2.5 | 1.0 | 3.5 | SD-1 | 40 | 10.70 |
| 1-17 | C-7 | 25 | 2.5 | 1.0 | 3.5 | SD-1 | 40 | 10.40 |
| 1-18 | C-7 | 25 | 2.5 | 1.0 | 3.5 | SD-1 | 40 | 10.00 |
| 1-19 | C-7 | 25 | 2.5 | 1.0 | 3.5 | SD-1 | 40 | 10.40 |

| | Running Condition | | Photographic Properties | | | | |
|---|---|---|---|---|---|---|---|
| Experiment No. | Replenishing Rate ml/m² | Processing Time sec | Realtive Sensitivity | Gamma Value | Rank of Sharpness | Number of Pepper Shots | Remarks |
| 1-1 | 270 | 20 | 100 | 11 | 3 | 300 or more | Comp. |
| 1-2 | 270 | 20 | 105 | 11 | 3 | 300 or more | Comp. |
| 1-3 | 270 | 20 | 108 | 11.2 | 3 | 300 or more | Comp. |
| 1-4 | 270 | 20 | 98 | 10.5 | 2.75 | 150 | Comp. |
| 1-5 | 270 | 20 | 95 | 10.0 | 2.50 | 145 | Comp. |
| 1-6 | 270 | 20 | 96 | 10.4 | 2.50 | 155 | Comp. |
| 1-7 | 270 | 20 | 94 | 10.2 | 2.50 | 88 | Comp. |
| 1-8 | 270 | 20 | 90 | 10.0 | 2.50 | 70 | Comp. |
| 1-9 | 250 | 20 | 96 | 10.2 | 2.25 | 89 | Comp. |
| 1-10 | 200 | 20 | 95 | 10.2 | 2.25 | 88 | Comp. |
| 1-11 | 150 | 20 | 94 | 10.2 | 2.25 | 145 | Comp. |
| 1-12 | 270 | 18 | 94 | 10.0 | 2.50 | 140 | Comp. |
| 1-13 | 270 | 12.5 | 92 | 10.1 | 2.50 | 140 | Comp. |
| 1-14 | 270 | 10 | 90 | 10.0 | 2.50 | 140 | Comp. |
| 1-15 | 270 | 20 | 102 | 11.1 | 3 | 300 or more | Comp. |
| 1-16 | 270 | 20 | 102 | 12.0 | 4.75 | 3 | Inv. |
| 1-17 | 270 | 20 | 101 | 12.3 | 4.75 | 3 | Inv. |
| 1-18 | 270 | 20 | 101 | 12.4 | 4.50 | 2 | Inv. |

TABLE 1-continued

| | | | | | | | |
|---|---|---|---|---|---|---|---|
| 1-19 | 250 | 20 | 100 | 12.4 | 4.75 | 3 | Inv. |

Comp.: Comparison
Inv.: Invention

TABLE 2

| Experiment No. | Light-sensitive Material: Hydrazine Compound: Compound | Hydrazine Compound: Amount Added mg/m² | Emulsion Layer Side Gelatin Content g/m²: Emulsion Layer | Protective Layer | Total | Developer: Standard Formulation | Amount of DEG g/l | Fresh Solution pH |
|---|---|---|---|---|---|---|---|---|
| 1-20 | C-7 | 25 | 2.5 | 1.0 | 3.5 | SD-1 | 40 | 10.40 |
| 1-21 | C-7 | 25 | 2.5 | 1.0 | 3.5 | SD-1 | 40 | 10.40 |
| 1-22 | C-7 | 25 | 2.5 | 1.0 | 3.5 | SD-1 | 40 | 10.40 |
| 1-23 | C-7 | 25 | 2.5 | 1.0 | 3.5 | SD-1 | 40 | 10.40 |
| 1-24 | C-7 | 25 | 2.5 | 1.0 | 3.5 | SD-1 | 40 | 10.40 |
| 1-25 | C-7 | 25 | 2.5 | 1.0 | 3.5 | SD-1 | 5 | 10.40 |
| 1-26 | C-7 | 25 | 2.5 | 1.0 | 3.5 | SD-1 | 0 | 10.40 |
| 1-27 | C-7 | 25 | 2.0 | 1.0 | 3.0 | SD-1 | 0 | 10.40 |
| 1-28 | C-7 | 25 | 1.5 | 0.8 | 2.3 | SD-1 | 0 | 10.40 |
| 1-29 | C-9 | 25 | 1.5 | 0.8 | 2.3 | LD-1 | 0 | 10.40 |
| 1-30 | C-9 | 25 | 1.5 | 0.8 | 2.3 | SD-1 | 0 | 10.40 |
| 1-31 | A-1* | 25 | 1.5 | 0.8 | 2.3 | LD-1 | 0 | 10.40 |
| 1-32 | A-1* | 25 | 1.5 | 0.8 | 2.3 | SD-1 | 0 | 10.40 |

| Experiment No. | Running Condition: Replenishing Rate ml/m² | Processing Time sec | Photographic Properties: Realtive Sensitivity | Gamma Value | Rank of Sharpness | Number of Pepper Spots | Remarks |
|---|---|---|---|---|---|---|---|
| 1-20 | 200 | 20 | 100 | 12.4 | 4.50 | 3 | Inv. |
| 1-21 | 150 | 20 | 99 | 12.3 | 4.50 | 3 | Inv. |
| 1-22 | 150 | 18 | 99 | 12.8 | 4.50 | 2 | Inv. |
| 1-23 | 150 | 12.5 | 98 | 12.6 | 4.50 | 2 | Inv. |
| 1-24 | 150 | 10 | 98 | 12.5 | 4.50 | 2 | Inv. |
| 1-25 | 150 | 12.5 | 100 | 12.4 | 4.25 | 3 | Inv. |
| 1-26 | 150 | 12.5 | 101 | 12.3 | 4.50 | 3 | Inv. |
| 1-27 | 150 | 12.5 | 108 | 12.9 | 4.75 | 1 | Inv. |
| 1-28 | 150 | 12.5 | 109 | 12.9 | 4.75 | 1 | Inv. |
| 1-29 | 150 | 12.5 | 89 | 10.0 | 2.25 | 300 or more | Comp. |
| 1-30 | 150 | 12.5 | 102 | 12.8 | 4.75 | 2 | Inv. |
| 1-31 | 150 | 12.5 | 88 | 9.9 | 2.0 | 300 or more | Comp. |
| 1-32 | 150 | 12.5 | 99 | 11.5 | 3.5 | 10 | Inv. |

Comp.: Comparison
Inv.: Invention
A-1*

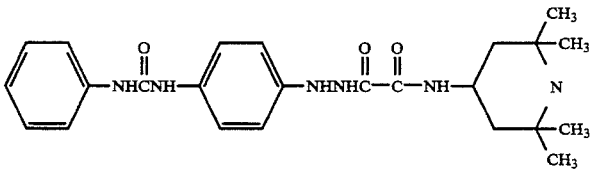

What is claimed is:

1. A process for processing a black-and-white silver halide photographic light-sensitive material comprising a support and provided thereon, a photographic component layer comprising a silver halide emulsion layer, said photographic component layer containing a hydrazine compound, comprising the step of:

exposing the light-sensitive material;

developing the exposed material with developer having a pH of not more than 10.7, said developer being prepared from a solid developing composition and said developer being replenished with developer replenisher in an amount of not more than 250 cc per m² of the light-sensitive material to be developed; and fixing the developed material with fixer.

2. The process of claim 1, wherein said developer is replenished with developer replenisher in an amount of 60 to 250 cc per m² of the light-sensitive material to be developed.

3. The process of claim 1, wherein said developer is replenished with developer replenisher in an amount of 100 to 200 cc per m² of the light-sensitive material to be developed.

4. The process of claim 1, wherein said developing is carried out in not more than 18 seconds.

5. The process of claim 1, wherein said developing is carried out in 7 to 18 seconds.

6. The process of claim 1, wherein said solid developing composition contains an organic solvent in an amount of not more than 100% by weight based on the total solid content.

7. The process of claim 1, wherein said photographic component layer contains gelatin in an amount of not more than 3.0 g per m² of the material.

8. The process of claim 1, wherein the hydrazine compound is a compound represented by the following Formula (H):

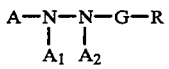

Formula [H]

wherein A represents an aryl group or a heterocyclic group containing a sulfur atom or an oxygen atom; G represents a

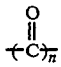

group, a sulfonyl group, a sulfoxy group, a

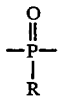

group or an iminomethylene group; wherein n is an integer of 1 or 2; $A^1$ and $A^2$ represent a hydrogen atom or when one of $A^1$and $A^2$ is a hydrogen atom, the other is an alkylsulfonyl group or an acyl group; R represents a hydrogen atom, an alkyl group, an aryl group, an alkoxy group, an aryloxy group, an amino group, a carbamoyl group, an oxycarbonyl group or —O—$R_2$ wherein $R_2$ represents an alkyl group or a saturated heterocyclic group.

9. The process of claim 1, wherein said fixing is carried out by fixer prepared from a solid fixing composition.

10. The process of claim 9, wherein said fixer contains a thiosulfate and has a pH of not less than 3.8.

11. The process of claim 8, wherein said hydrazine compound is a compound represented by the following Formula (H-c) or (H-d):

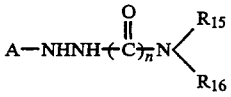

Formula [H-c]

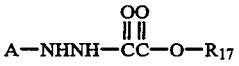

Formula [H-d]

wherein A represents an aryl group or a heterocyclic group containing a sulfur atom or an oxygen atom; n is an integer of 1 or 2; $R_{15}$ and $R_{16}$ independently represent a substituent; and $R_{17}$ represents an alkynyl group or a saturated heterocyclic group; wherein, when n is 1, said substituent represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclicoxy group or $R_{15}$ and $R_{16}$ may form a ring together with a nitrogen atom or when n is 2, said substituent represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclicoxy group, provided that at least one of $R_{15}$ and $R_{16}$ represents an alkenyl group, an alkynyl group, a saturated heterocyclic group, a hydroxy group, an alkoxy group, an alkenyloxy group, an alkynyloxy group, an aryloxy group or a heterocyclicoxy group.

12. The process of claim 11, wherein said hydrazine compound is contained in said photographic component layer in an amount of $1\times10^{-6}$ to $1\times10^{-1}$ mol per mol of silver.

13. The process of claim 6, wherein said solid developing composition further contains a granulation aid.

14. The process of claim 13, wherein said solid developing composition is a tablet or a granule.

15. A process for processing a black-and-white silver halide photographic light-sensitive material comprising a support and provided thereon, a photographic component layer comprising a silver halide emulsion layer and layers adjacent thereto, said photographic component layer containing a hydrazine compound in an amount of $1\times10^{-6}$ to $1\times10^{-1}$ mol per mol of silver and gelatin in an amount of not more than 3.0% by weight, comprising the step of:

exposing the light-sensitive material;

developing the exposed material with developer having a pH of not more than 10.7 in not more than 18 seconds, said developer being prepared from a solid developing composition containing a granulation aid, and replenished with developer replenisher in an amount of not more than 250 cc per $m^2$ of the light-sensitive material to be developed;

fixing the developed material with fixer, wherein said hydrazine compound is a compound represented by the following Formula (H-c) or (H-d):

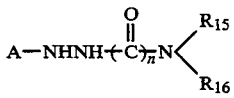

Formula [H-c]

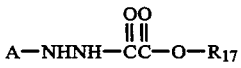

Formula [H-d]

wherein A represents an aryl group or a heterocyclic group containing a sulfur atom or an oxygen atom; n is an integer of 1 or 2; $R_{15}$ and $R_{16}$ independently represent a substituent; and $R_{17}$ represents an alkynyl group or a saturated heterocyclic group; wherein, when n is 1, said substituent represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclicoxy group or $R_{15}$ and $R_{16}$ may form a ring together with a nitrogen atom or when n is 2, said substituent represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclicoxy group, provided that at least one of $R_{15}$ and $R_{16}$ represents an alkenyl group, an alkynyl group, a saturated heterocyclic group, a hydroxy group, an alkoxy group, an alkenyloxy group, an alkynyloxy group, an aryloxy group or a heterocyclicoxy group.

* * * * *